United States Patent [19]

Ogihara et al.

[11] 4,293,938

[45] Oct. 6, 1981

[54] ALARM SIGNALING TIME DETECTING DEVICE FOR DIGITAL CLOCK

[75] Inventors: Masuo Ogihara; Kozo Chimura; Nobuo Shinozaki; Yoichi Seki, all of Yotsukaido, Japan

[73] Assignee: Seiko Koki Kabushiki Kaisha, Tokyo, Japan

[21] Appl. No.: 107,516

[22] Filed: Dec. 27, 1979

[30] Foreign Application Priority Data

Dec. 28, 1978 [JP] Japan ..... 53-163743

[51] Int. Cl.[3] ..... G04B 23/02; G04B 19/02; G04C 21/16

[52] U.S. Cl. ..... 368/72; 368/222; 368/254

[58] Field of Search ..... 58/16 D, 19 R, 38 R, 58/38 A; 368/72–74, 222, 235, 250, 254

[56] References Cited

U.S. PATENT DOCUMENTS

| | | | |
|---|---|---|---|
| 3,685,280 | 8/1972 | Fehrenbacher | 58/38 A |
| 4,070,822 | 1/1978 | Arai | 58/19 A |
| 4,172,358 | 10/1979 | Saginoya | 58/38 R |

*Primary Examiner*—Vit W. Miska

*Attorney, Agent, or Firm*—Robert E. Burns; Emmanuel J. Lobato; Bruce L. Adams

[57] ABSTRACT

An alarm signaling time setting member is coupled to a minute indication drum having minute-scale alarm time graduations and an hour indication drum having hour-scale alarm signaling time graduations is intermittently advanced by the minute indication drum. First and second detection members for detecting the alarm signaling time are provided in correspondence to an hour time wheel and a minute time wheel respectively. The first detection member is geared to the second detection member, and the second detection member is geared to the minute indication drum to permit the detection member positions to be continuously set.

10 Claims, 10 Drawing Figures

ALARM SIGNALING TIME DETECTING DEVICE FOR DIGITAL CLOCK

BACKGROUND OF THE INVENTION

This invention relates to an alarm signaling time detecting for a digital clock.

In the conventional drum type or leaf type digital clock, it is usual to set a desired alarm signaling time by setting a corresponding graduation on a drum, which has such graduations and digital figures for respective hours, relative to a fixed index.

In such a case, it is very difficult to accurately visually determine on the minute scale the alarm signaling time to which the clock is to be set.

SUMMARY OF THE INVENTION

An object of the invention is to overcome the above drawback and permit accurate digital display of the alarm signaling time on the minute scale for facilitating the setting of the alarm signaling time.

According to the invention the above object is achieved by providing first and second detection members for detecting the alarm signaling time in correspondence to hour and minute hand wheels, respectively, and also providing an hour indication drum for displaying the hour unit of the alarm signaling time and a minute indication drum for displaying the minute unit of the alarm signaling time. The indication drums are geared to the respective detection members to allow the positions of the detection members to set continuously by setting the indication drums.

DESCRIPTION OF THE PREFERRED EMBODIMENTS

Figure 1:
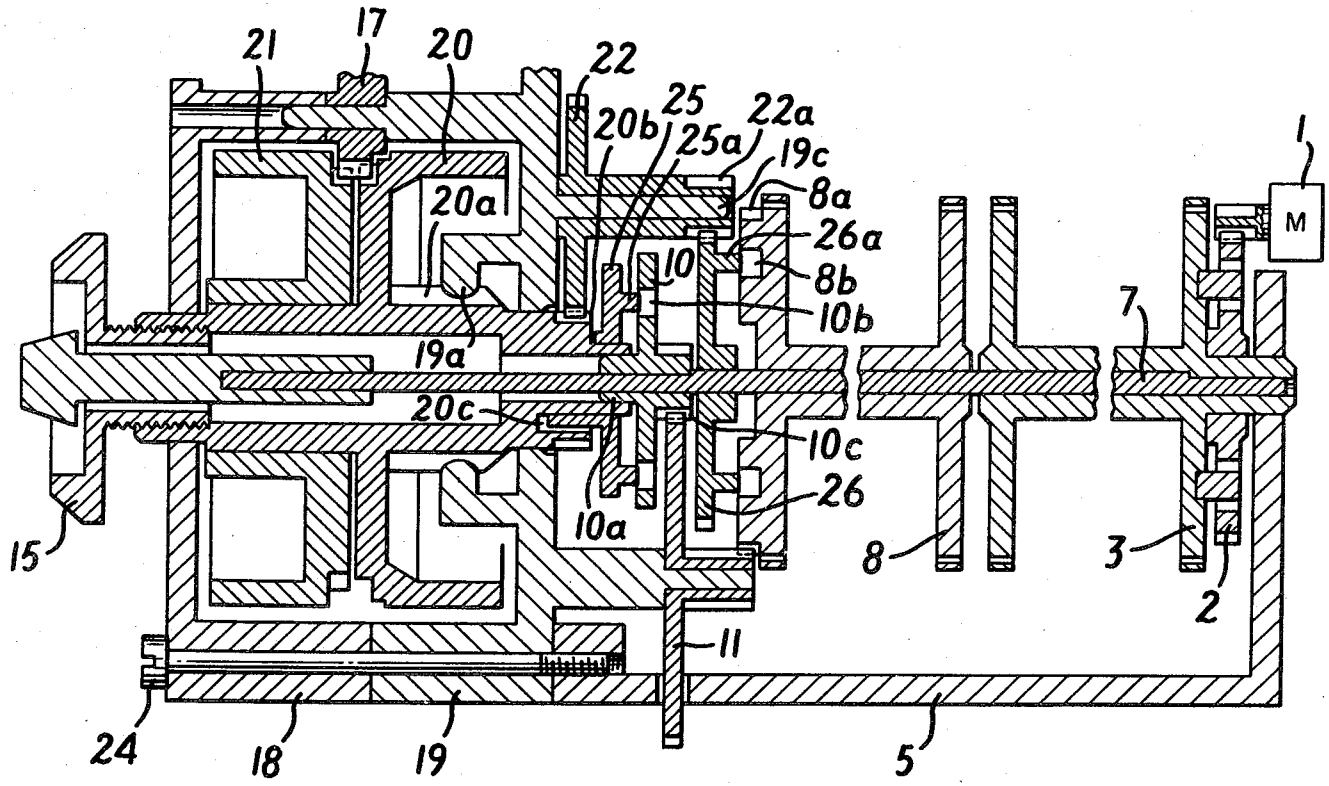
FIG. 1 is a sectional view showing the main construction of a first embodiment.

Now, the preferred embodiments illustrated in the drawings will be described in detail. First, the construction of a first embodiment shown in FIGS. 1 to 4 will be described.

An alarm signaling time indication mechanism will first be described. Designated at 1 is a driving motor, which is meshed with a minute hand wheel 2 for driving the same at a speed of one rotation per 60 minutes. The minute hand wheel 2 is coupled through a well-known ratchet mechanism to a minute leaf drum 3 for rotating the drum only in one direction. The minute leaf drum 3 is secured to a shaft 7. Its right hand end is journalled in a case 5, and it has 60 minute leaves.

Figure 3:
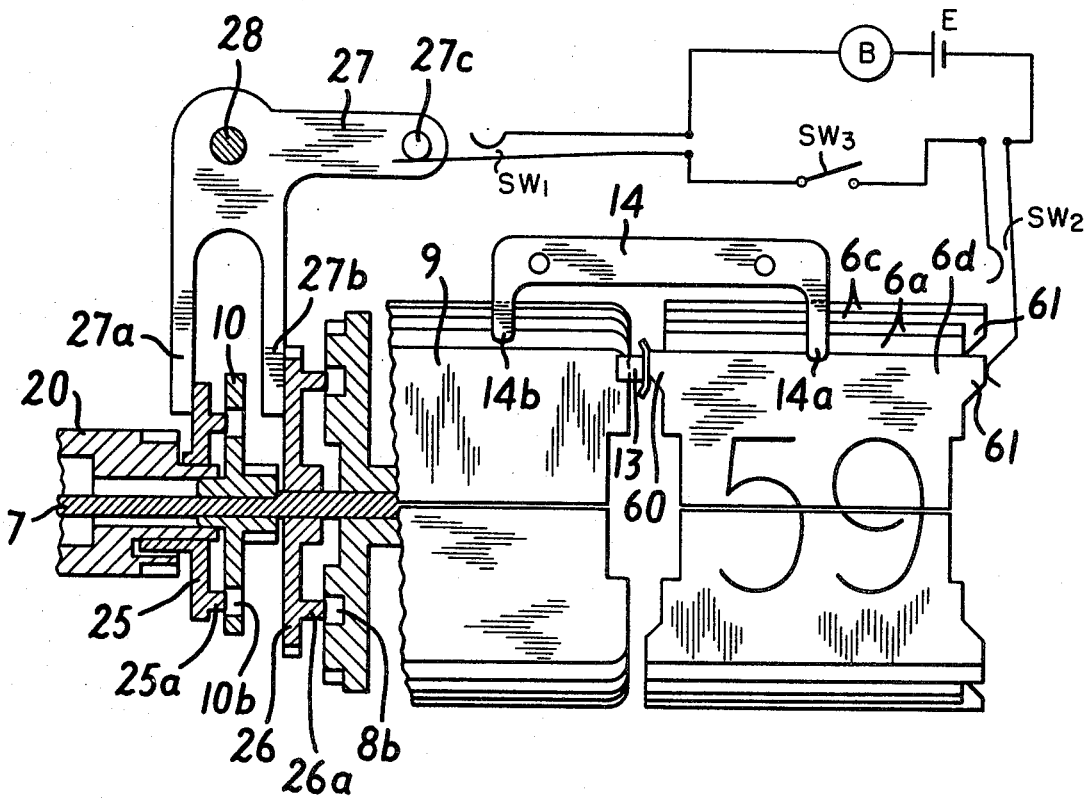
FIGS. 3 and 4 show some portions in the construction of FIG. 1.
Figure 4:
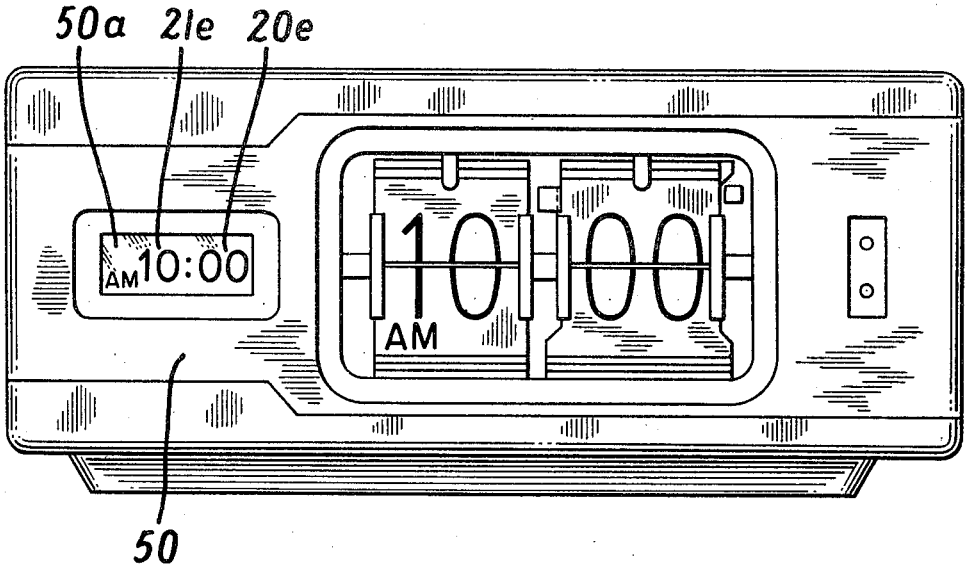
Figure 5:
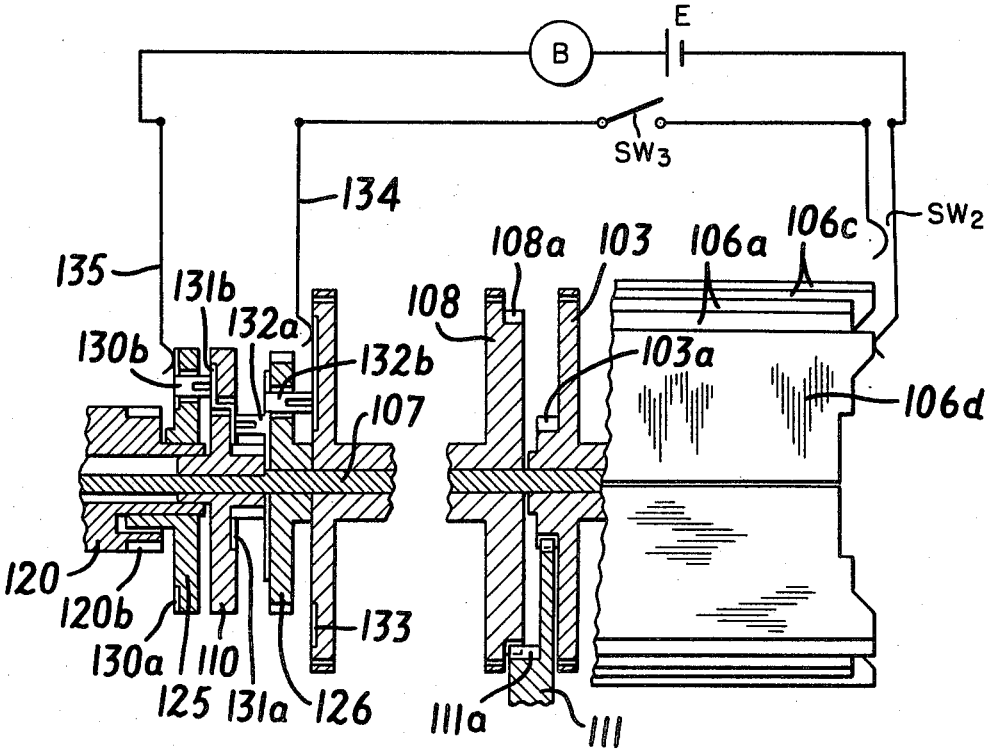
FIG. 5 is a sectional view showing the main construction of a second embodiment.

As shown in FIG. 3, these minute leaves include first minute leaves 6*a* having no projection, second minute leaves 6*b* each provided on the left hand edge with a projection (not shown), third minute leaves 6*c* each provided at the right hand edge with a projection (not shown) and fourth minute leaves 6*d* each provided at both the left and right hand edges with respective projections 60 and 61 (not shown). Of these minute leaves, first minute leaves 6*a* are used when indicating "00" and "01" minutes past a given hour, third minute leaves 6*c* are used when indicating "02", "03" and "04" minutes past a given hour, first minute leaves 6*a* are again used when indicating "05" and "06" minutes past a given hour, and so on; two first minute leaves 6*a* and three third minute leaves 6*c* are combined and arranged as leaves for indicating up to "44" minutes past a given hour.

Second minute leaves 6*d* are used when indicating "45" and "46" minutes past a given hour, fourth minute leaves 6*d* are used when indicating "47," "48" and "49" minutes past a given hour, and so on; two second minute leaves 6*d* and three fourth minute leaves 6*d* are combined and arranged for indicating up to "59" minutes past a given hour.

Designated at 8 is an hour leaf drum rotatably supported by the shaft 7, and it has 48 hour leaves 9. A second minute hand wheel 10 is secured to an intermediate portion of the shaft 7, and its boss 10*a* is rotatably supported by a minute indication drum 20. It has cam holes 10*b* and a pinion 10*c*. The pinion 10*c* is geared through an intermediate hour wheel 11 to an hour hand wheel 8*a* provided on the hour leaf drum 8.

The hour hand wheel 8*a* is formed on the left side of the hour leaf drums 8, with cam holes 8*b* formed in the face of the hour hand wheel 8*a*.

Designated at 13 is an hour leaf holding spring. When an hour leaf 9 is raised in an interlocked relation to the left hand projections 60 of the second and fourth minute leaves, the hour leaf 9 is held by the spring 13 so that it will be inverted even if it is detached from a second pawl 14*b* of a feed spring 14, and it is inverted simultaneously with the detachment of the fourth minute leaf 6*d* indicating "59" minutes past a given hour from a first pawl 14*a* of the feed spring, at which time "00" minute past the next hour is indicated and also the hour leaf 9 is released from the spring 13 .

Figure 2A:
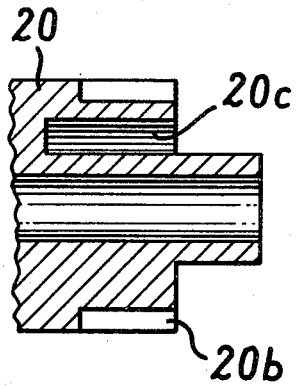
FIGS. 2*a* and 2*b* show guide sections of the minute detection drum and minute detection member in detail.
Figure 2B:
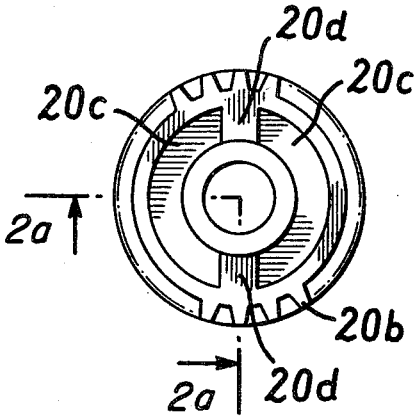

Now, an alarm signaling mechanism will be described. Designated at 15 is an alarm signaling time setting knob, which is coupled to a minute indication drum 20 having a 60-minute scale of time graduations 20*e* provided at five minute intervals for indicating alarm time. The minute indication drum 20 is rotatably supported on one side by an intermediate member 19 secured by screws 24 to the case 5 and on the other side by a side member 18 secured to the intermediate member 19. An hour indication drum 21, which is advanced by one pitch with one rotation of the minute indication drum 20 through a carry gear 17, is rotatably supported on a central boss of the minute indication drum 20. The hour indication drum 20 has alarm time graduations and figures 21*e* inscribed on its surface. The alarm time figures 20*e* and 21*e* provided on the drums can be seen through an alarm signaling time display window 50*a* on the front plate 50 of the clock. The minute indication drum 20 is provided in its intermediate portion with a click gear 20*a*, which engages with a click spring 19*a* projecting from the intermediate member 19 and provides a click stop action at an interval of, for example, five minutes when the knob 15 is rotated. The minute indication drum 20 is also provided adjacent to its right hand end with grooves 20*c* and ribs 20*d* between these grooves, as shown in FIGS. 2*a* and 2*b*, and a minute detection member 25 is coupled to the minute indication drum 20 such that it is not rotatable but movable in the axial direction with respect to the minute indication drum.

The minute indication member 25 has cams 25*a*, which can be received in the afore-mentioned cam holes 10*a* in the second minute hand wheel. The minute indication drum 20 is further provided adjacent to its right hand end with a pinion 20*b* which is meshed with an intermediate wheel 22, which is in turn guided for rotation by a boss 19*c* projecting from the intermediate member 19. The intermediate wheel 22 has a pinion 22*a* which is rotatable with the shaft 7 and meshed with the gear of an hour detection member 26, which is movable relative to the shaft 7. The hour detection member 26 has cams 26*a*, which can be received in the afore-mentioned cam holes 8*b* in the hour drum.

Now, an alarm signaling time detecting mechanism shown in FIG. 3 will be described. Designated at 27 is a pair of detecting arms 27*a* and 27*b* respectively adapted to cooperate with the afore-mentioned minute and hour detection members 25 and 26, and a pin 27*c* about which the pair of detecting arms pivot for operating a first switch $SW_1$.

A second switch $SW_2$ is adapted to cooperate with the right hand projections of the third and fourth minute leaves 6*c* and 6*d*.

A third switch $SW_3$ is a so-called alarm stopping switch, and it is closed when the user wants to use a buzzer B. The switches $SW_1$ to $SW_3$ and buzzer B are connected in series across a power supply E.

An additional description of the detecting mechanism will now be made. Although the alarm signaling time is digitally indicated, since the minute and hour detection members 25 and 26 are coupled through gears to the pinion 20*a* of the minute indication drum, the phase of the hour detection member 26 changes continuously so that the hour detection member phase is an analog parameter. Thus, even if the minute detection member 25 is designed such that it is received in the second minute hand wheel 10 for a constant period of time (for instance, 5 minutes or 10 minutes), so long as the period during which the hour detection member 26 is received in the holes 8*b* of the hour drum is set to be within one hour (for instance 30 minutes), even with the setting of the alarm signaling time to an instant near the instant of switching of alarm signaling times, for instance 55 minutes past a given hour, the hour detection member 26 is displaced continuously by an angle corresponding to the afore-mentioned 55 minutes past a given hour, so that there is no possibility of erroneously signaling the alarm.

The operation of the above-described structure will now be described. When it is desired to use the alarm signaling device, the third switch $SW_1$ is first closed, and then the desired time is set by turning the knob 15 while watching the figures inscribed in the minute and hour indication drums 20 and 21. With the setting of the alarm signaling time the phases of the cams 25*a* and 26*a* of the minute and hour indication members 25 and 26 are determined. When the clock is left in this state, the motor 1 rotates the minute hand wheel 2, minute drum 3 and second hand wheel 10 and also rotates the hour drum 8 through the intermediate hour wheel 11. In this state, the cam hole 8*b* of the hour drum 8 and the cams 26*a* of the hour detection member 26 first come to coincidence with one another, so that the hour detection member 26 is now capable of being moved in the rightward direction by the force of the first switch $SW_1$ through the first detecting lever 27. At this time, however, the cams 25*a* of the minute direction member and cam holes 10*b* of the second minute hand wheel are not yet brought into coincidence with one another, and thus the rotation of the first detecting lever 27 is not caused. Thus, the first switch $SW_1$ is not closed.

With further rotation of the hour hand wheel 8*a* the cams 25*a* of the minute detection member 25 eventually come to coincidence with the cam holes 10*b* of the second minute hand wheel 10. At this time, the minute detection member 25 is capable of being moved rightwards. Thus, the detecting lever 27 is rotated counterclockwise by the force of the first switch $SW_1$ to close the first switch $SW_1$. At this time, the tip of the second switch $SW_2$ is co-operating with the right hand projection 61 of the third or fourth leaf 6*c* or 6*d* as shown in FIG. 3, so that the second switch $SW_2$ remains "off," and the buzzer B is not operated yet. When the leaf indicating the "59" minutes past a given hour, as shown in FIG. 3, is inverted to "00," there is no longer any projection restricting the second detecting lever. As a result, the second switch $SW_2$ is closed by its own spring force, whereby the buzzer B is operated.

At this time, the operation of the buzzer B can be stopped by opening the third switch $SW_3$. If the buzzer is left sounding without taking the measure of stopping it, after a lapse of a couple of minutes from the triggering of the buzzer B the second switch $SW_2$ is again operated by the right hand projection of 61 of the third minute leaf 6*c* and is thus closed, thus stopping the buzzer B once. When the time is further elapsed until "05" minutes past the given hour is indicated, the projection again disappears, so that the second switch $SW_2$ is closed again to operate the buzzer B. In this way, if the measure of stopping the buzzer sound is not taken, the buzzer B is repeatedly caused to sound for every five minutes until the cams 25*a* of the minute detection member escapes from the cam holes 10*b* of the second minute hand wheel.

A second embodiment shown in FIGS. 5, 6*a*, 6*b*, 6*c* and 6*d* will now be described.

This embodiment is different from the first embodiment in the hour leaf drum advance mechanism and alarm signaling time detection mechanism, and these different portions will be described.

In the alarm signaling time indicating mechanism, a minute leaf drum 103 having minute leaves 106*a* to 106*d* similar to those in the first embodiment is provided at the left hand end with an integral pinion 103*a* which meshes with an intermediate hour wheel 111. An hour leaf drum 108 is also provided at its right hand end with an hour hand wheel 108*a* meshing with a pinion 111*a* provided on the intermediate hour wheel 111.

Figure 6D:
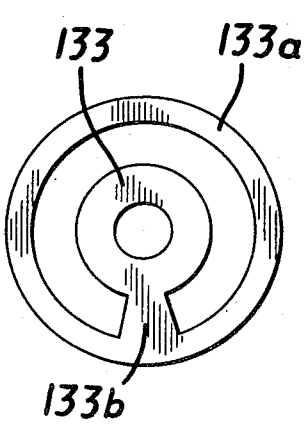
FIGS. 6*a*, 6*b*, 6*c* and 6*d* show switch plates comprising a portion of the construction of FIG. 5.
Figure 6C:
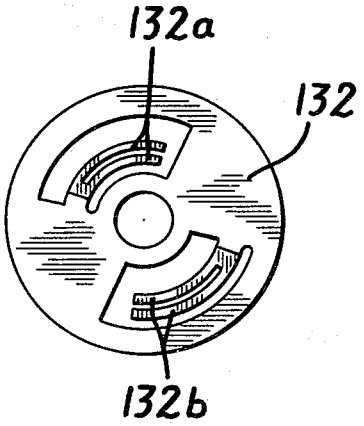

Now, the alarm signaling time indicating mechanism will be described. Designated at 125 is a minute detection member which is integral with a minute indication drum 120 like the first embodiment. It has a first switch member 130 as shown in FIG. 6*a*, which is secured to the surface of the minute detection member 125. The first switch 130 has a disc portion 103*a* which is always in contact with a slide contact piece 135 of a first switch $SW_1$ and a contact arm 130*b* extending rightwards through a hole formed in the minute direction member 125.

Figure 6B:
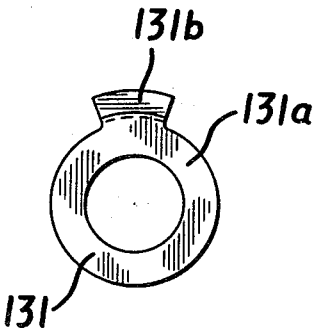
Figure 6A:
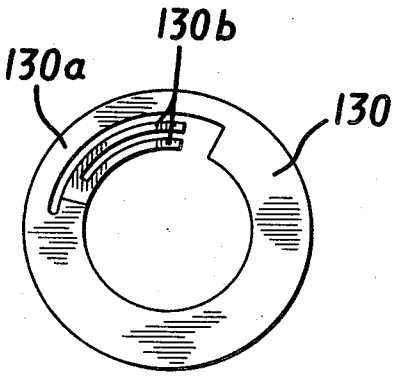

Designated at 110 is a second minute hand wheel secured to a shaft 107, and it has a second wheel member 131 as shown in FIG. 6*b*, secured to its surface. The second switch member 131 has a disc portion 131*a* and a sector-shaped switch section 131*b* penetrating and extending parallel to the left hand side of the second minute hand wheel 110. The sector-shaped switch section 131*b* is capable of being brought into contact with the contact arm 131*b* of the first switch member.

Designated at 126 is an hour detection member which is coupled through a second intermediate hour wheel (not shown) to a pinion 120*b* of the minute indication drum like the first embodiment, and it has a third switch member 132 as shown FIG. 6*c*, secured to its surface. The third switch member 132 has a first contact arm 132*a* extending leftwards and always in contact with the disc portion of the first switch member and a second contact arm 132*b* penetrating and rightwardly extending through a hole in the hour detection member 126. The hour leaf drum 108 has a fourth switch member 133 as shown in FIG. 6*d*, secured to the left side of the drum. The fourth switch member 133 has a disc portion 133*a* which is always in contact with a contact piece 134 of the first switch $SW_1$ and a sector-shaped section 133*b* capable of being brought into contact with the second contact arm 132*b* of the third switch member. The first switch $SW_1$ is connected in series with a second switch $SW_2$, a manually operable third switch and a buzzer B across a power supply E as in the first embodiment.

In operation, when an alarm signaling time which has been previously set is approached as the clock is being driven, the sector-shaped switch section 113*b* of the fourth switch member 133 is first brought into contact with the second contact arm 132*b* of the third switch member. At this time, the second switch member 131 and first switch member 130 are not yet in contact with each other, so that the buzzer B is not operated yet. When the preset alarm signaling time is further approached, the sector-shaped switch section 131*b* of the second switch member is at this time brought into contact with the contact arm 130*b* of the first switch member, whereby the two slide contact pieces 135 and 134 are electrically connected to each other. As a result, the first switch $SW_1$ is closed. However, the second switch $SW_2$ is raised at this time by the right hand projection 161 of the corresponding minute leaf and is not closed, so that the buzzer B is not operated yet.

When the alarm signaling time is reached, causing the inversion of the fourth minute leaf 106*d*, the second switch $SW_2$ is no longer restricted by any projection so that it closes itself by its own force. With the closure of the second switch $SW_2$ the whole circuit loop is closed, whereby the buzzer B is operated. The subsequent operation is the same as in the case of the first embodiment, so that it is not described here.

As has been shown, according to the invention the alarm signaling time is indicated in minutes by digital figures, so that the user can accurately set the desired time. In addition, as has been shown in the second embodiment, the alarm signaling device can be accurately started at the desired time by using the minute leaves for the final detection of the preset alarm signaling time.

What is claimed is:

1. In an alarm signaling time indicating device for a digital clock having an alarm device and hour and minute time wheels, said time indicating device comprising: an alarm signaling time setting member; a minute indication drum positionable by said alarm signaling time setting member and provided on the outer periphery with minute-scale alarm signaling time graduations; an hour indication drum intermittently fed by said minute indication drum and provided on the outer periphery with hour-scale alarm signaling time graduations; at least first and second detection members provided in correspondence with the hour and minute time wheels respectively for detecting the alarm time; and a gear train coupling said first detection member to said minute indication drum to permit continuous setting of said first detection member by setting said minute indicating drum.

2. An alarm signaling time detecting device according to claim 1, wherein a click stop action is provided for each of the figures provided on said minute indication drum.

3. An alarm signaling time detecting device according to claim 2, wherein said second detection member and minute time wheel form a detecting mechanism consisting of a projected cam and a hole, said second detection member being splined to an associated one of said indication drums.

4. An alarm signaling time detecting device according to claim 1, in which the time is indicated by hour and minute leaves, some of said minute leaves each being provided with a projection, and which also comprises a third detecting means adapted to co-operate with said projection, said alarm device being actuated when said third detecting means is detached from said projection after detection of the alarm signaling time is made by said first and second detection members.

5. An alarm signaling time detecting device according to claim 4, wherein phase detection means consisting of a projected cam and a hole are formed between said hour time wheel and said first detection member and also between said minute time wheel and said second detection member.

6. An alarm signaling time detecting time device according to claim 4, wherein slide switch type phase detection means are provided between said hour time wheel and said first detection member and also between said minute time wheel and said second detection member.

7. In an alarm timepiece, the combination comprising: time indicating means for indicating time; a minute indicating drum having minute graduations thereon and positionable for setting the minutes of an alarm time; an hour indicating drum having hour graduations thereon and positionable for setting the hour of an alarm time; hour indicating drum advancing means operated by said minute indicating drum for advancing said hour indicating drum as said minute indicating drum is advanced to set an alarm time; first and second positionable detection members respectively corresponding to hours and minutes of the alarm time; detection member positioning means cooperative with said minute indicating drum for continuously positioning said detection members to set the alarm time as said minute indicating drum is positioned; and alarm means responsive to the positions of said detection members and responsive to the time indicated by said time indicating means for emitting an alarm signal when the time indicated by said time indicating means is the same as the time represented by the positions of said detection members.

8. In an alarm timepiece according to claim 7: a shaft mounted for rotation; said time indicating means comprising a minute leaf drum mounted on said shaft and fixed to said shaft for rotation therewith, an hour leaf drum mounted on said shaft for rotation thereon and for rotation relative to said minute leaf drum, and minute and hour leaves respectively mounted on said minute leaf drum and said hour leaf drum for indicating time as said minute and hour leaf drums rotate; said minute indicating drum and said hour indicating drum being mounted for rotation on said shaft; said first and second pair of detection members comprising a pair of disc-shaped members mounted for rotation on said shaft between said minute indicating drum and said hour leaf drum.

9. In an alarm timepiece according to claim 8: a minute wheel mounted for rotation on said shaft between said detection members; wherein said detection members are slidable along said shaft a minute detection member adjacent said minute indication drum having a face facing said minute wheel with cams protruding from the face toward said minute wheel, an hour detection member adjacent said hour leaf drum having a face facing said hour leaf drum with cams protruding from the face toward said hour leaf drum, and said minute wheel and said hour leaf drum having recesses for receiving the respective cams of said minute and said hour detection members when said minute wheel and said hour drum are positioned relative to said detection members for receiving said cams; means for rotating said minute wheel in response to rotation of said minute leaf drum; and switching means within said alarm means operated by said detection members when said detection means are positioned with their respective cams in the recesses of said minute wheel and said hour leaf drum for enabling said alarm means.

10. In an alarm time timepiece according to claim 8: a minute wheel mounted for rotation on said shaft between said detection members; wherein said detection members are slidable along said shaft, said detection members, said minute wheel and a face of said hour leaf drum facing said detection members having thereon conductive switch members and contact arms protruding therefrom for making contact with adjacent switch members, said switch members being configured for defining a continuous circuit path through the respective switch members carried by said detection members, said minute wheel and said hour leaf drum when said minute wheel and said hour leaf drum have rotated to positions corresponding to the alarm time; and said alarm means being connected to the respective switch members carried by said hour leaf drum and a minute detection member when said continuous circuit path is established therebetween for enabling said alarm means to emit an alarm signal.

* * * * *